United States Patent [19]

Wood

[11] 4,049,189

[45] Sept. 20, 1977

[54] PANEL INTERLOCKING MEANS AND METHOD

[75] Inventor: Prentice J. Wood, Jonesboro, Ga.

[73] Assignee: The Mead Corporation, Dayton, Ohio

[21] Appl. No.: 661,057

[22] Filed: Feb. 25, 1976

Related U.S. Application Data

[63] Continuation of Ser. No. 542,913, Jan. 22, 1975, abandoned.

[51] Int. Cl.[2] ..... B65D 5/02

[52] U.S. Cl. ..... 229/48 R; 229/40

[58] Field of Search ..... 229/48 R, 35, 36, 39 R, 229/40

[56] References Cited

U.S. PATENT DOCUMENTS

| | | | |
|---|---|---|---|
| 1,104,821 | 7/1914 | Morrison | 229/36 X |
| 2,060,240 | 11/1936 | Pergande | 229/39 R |
| 2,177,993 | 10/1939 | Olsen | 229/36 X |
| 2,190,433 | 2/1940 | Palmer | 229/36 X |
| 2,898,028 | 8/1959 | Coe | 229/36 X |
| 2,950,854 | 8/1960 | Ganz | 229/40 |
| 2,986,857 | 6/1961 | Ganz | 53/14 |
| 3,432,029 | 3/1969 | Brown | 229/40 X |
| 3,556,386 | 1/1971 | Ganz | 229/40 |

FOREIGN PATENT DOCUMENTS

| | | | |
|---|---|---|---|
| 1,355,681 | 2/1964 | France | 229/39 R |
| 149,404 | 7/1903 | Germany | 229/39 R |

*Primary Examiner*—Stephen P. Garbe
*Attorney, Agent, or Firm*—Walter M. Rodgers

[57] ABSTRACT

An article carrier having top, bottom and side walls interconnected to form a tubular structure is provided with end closure means in the form of door-like panels hinged to each end edge of each side wall, the door-like panels being folded into overlapping relationship and being secured together by interlocking means which comprises a locking aperture formed in one panel at each end of the carrier and arranged to cooperate with a locking panel foldably joined with the other panel and having an integral locking heel and a locking toe foldably joined to the locking panel, the locking heel and locking toe being arranged for insertion into the locking aperture in such manner as to secure the locking panel in flat face contacting relation with the panel in which a locking aperture is formed in order to secure these panels in overlapping relationship thereby to close the ends of the carrier.

11 Claims, 7 Drawing Figures

10
11
9
7
8
6
24
15
18
2
22
13
12
23
3
14

45
37
39
34
33
13
22
32
46
40
38
15
12
1b
1b 32
33
13
12

8a
9
11
30
24
10
22
28
17
19
4
15
13
29
23
5
31
25
1
3
27
21
16
18
2
14
12
26
20
7
8
6

11a

PANEL INTERLOCKING MEANS AND METHOD

This is a continuation of application Ser. No. 542,913 filed Jan. 22, 1975, now abandoned.

In one known type of panel interlocking means, a locking panel having an integral locking heel is foldably joined to one panel to be interlocked with aother panel and is arranged for insertion into a locking aperture formed in the other panel. A locking tongue is foldably joined to the locking panel and is arranged for insertion into an aperture formed in the other panel. Such know interlocking means does not afford a high degree of security since the locking tongue may be withdrawn from its associated aperture accidentally due to its hinged relationship with its associated locking panel because there is no positive interlock between the locking tongue and its associated aperture.

According to this invention a high degree of security is afforded by a so-called heel and toe locking arrangement. More specifically and in accordance with one form of this invention, one panel is foldably joined to a conventional locking panel whose associated locking heel is held in secure interlocked relationship within a locking aperture formed in another panel to be interlocked due to the fact that the locking toe is provided with a neck portion and a shoulder portion wherein the inherent bias of material along the hinged neck of the locking toe causes its shoulders to engage portions of the other panel which define holding edges to establish a positive and secure interlocked relationship when inserted into the locking aperture.

For a better understanding of the invention reference may be had to the following detailed description taken in conjunction with the accompanying drawings in which FIG. 1 is a perspective view of an article carrier having end closure panels secured together in interlocked overlapping relationship according to this invention;

FIG. 1*a* is a detailed view of one interlocking means as viewed from the inside of the associated end closure panels;

FIG. 1*b* is a profile view of FIG. 1*a* taken along line 1*b*—1*b* of FIG. 1*a;*

FIG. 4 is an enlarged fragmentary plan view of interlocking elements formed according to this invention; and in which

Figures 1, 1A, 1B, 2:
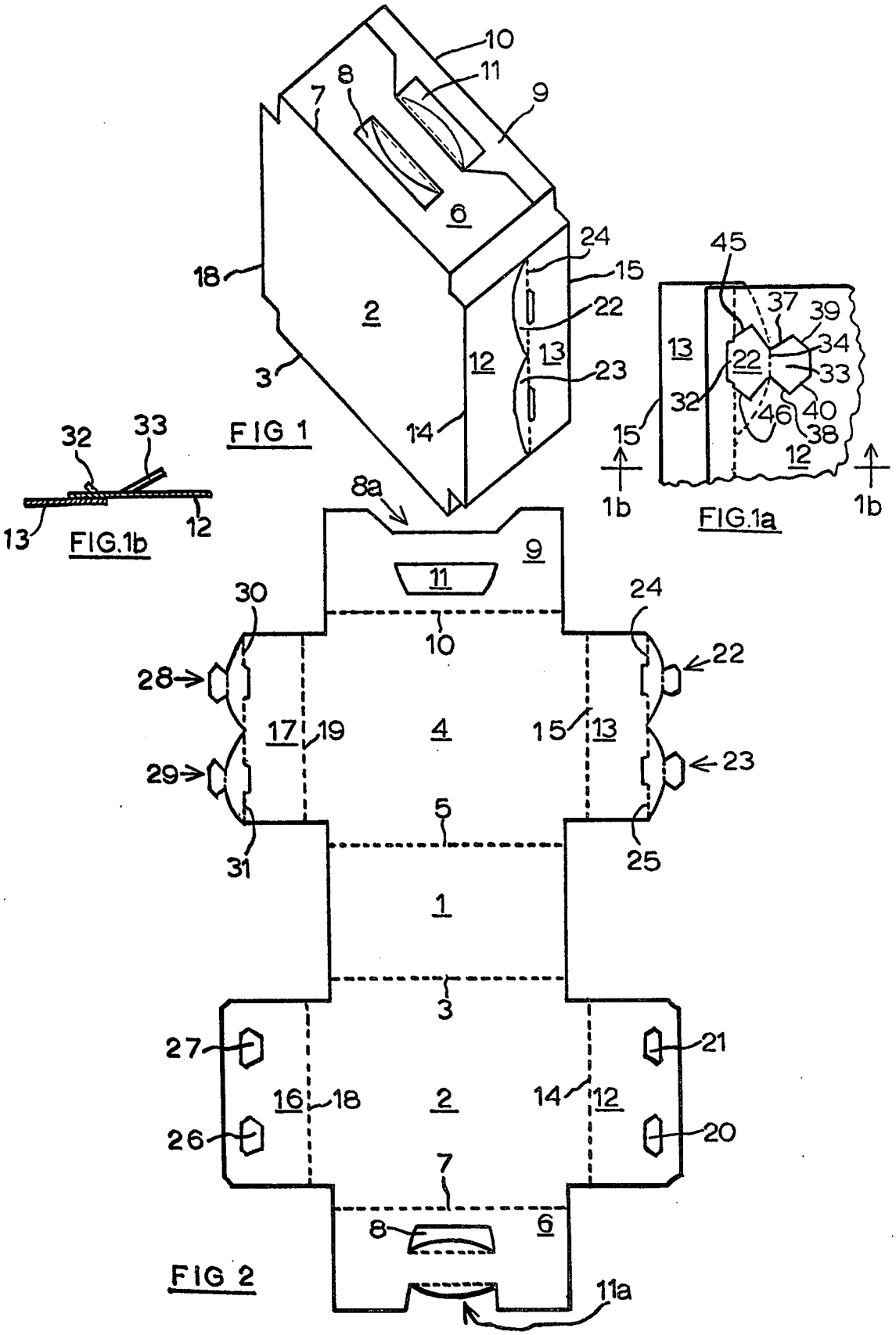
FIG. 2 is a plan view of a unitary blank from which the carrier shown in FIG. 1 is formed.

In the drawings the numeral 1 designates the bottom wall of the carrier. Side wall 2 is foldably joined to bottom wall 1 along fold line 3 while side wall 4 is foldably joined to the opposite side edge of bottom wall 1 along fold line 5. Top lap panel 6 is foldably joined along fold line 7 to the top edge of side wall 2 and is provided with a hand gripping aperture designated by the numeral 8. Top lap panel 9 is foldably joined to the top edge of side wall 4 along fold line 10 and is provided with a hand gripping aperture designated by the numeral 11.

One end of the carrier is closed by door-like panels designated by the numerals 12 and 13, Panel 12 is foldably joined to one end of side wall 2 along fold line 14 while panel 13 is foldably joined to one end of side wall 4 along fold line 15.

The other end of the carrier is closed by door-like end panels 16 and 17 which are foldably joined to the end edges of side walls 2 and 4 respectively along fold lines 18 and 19.

Figure 4:
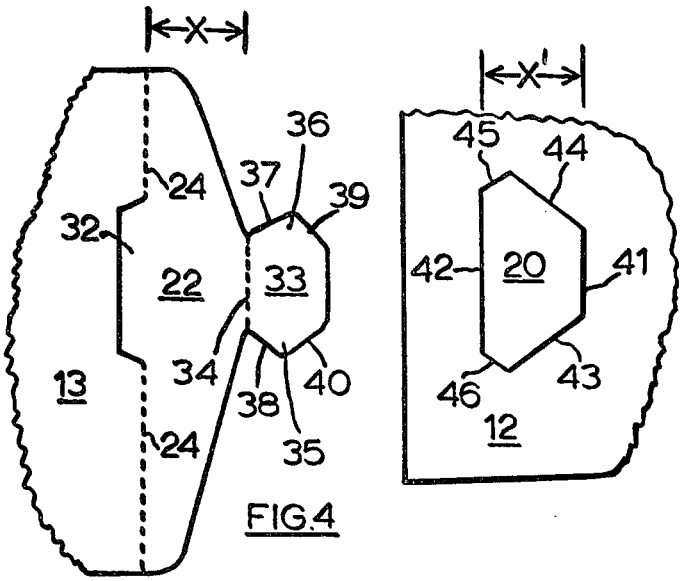
Figure 5:
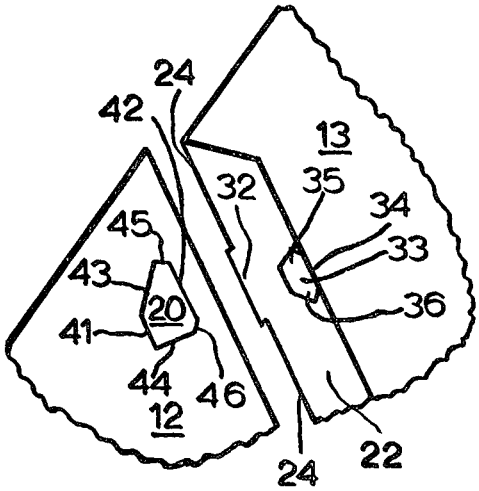
FIG. 5 is an enlarged perspective view of interlocking means by which the door-like end panels of the carrier are interlocked according to this invention.

Panels 12 and 13 are secured together in overlapping relationship by interlocking means contructed according to this invention and which is best shown in detail in FIGS. 4 and 5. Such interlocking means comprises locking apertures 20 and 21 which are formed in panel 12 and which cooperate respectively with locking panels 22 and 23 which are foldably joined respectively to panel 13 along fold lines 24 and 25.

Door-like panels 16 and 17 at the other end of the carrier are interlocked according to this invention by locking apertures 26 and 27 which are formed in door-like end panel 16 and which cooperate respectively with locking panels 28 and 29 which are foldably joined to panel 17 along fold lines 30 and 31 respectively.

Figure 3:
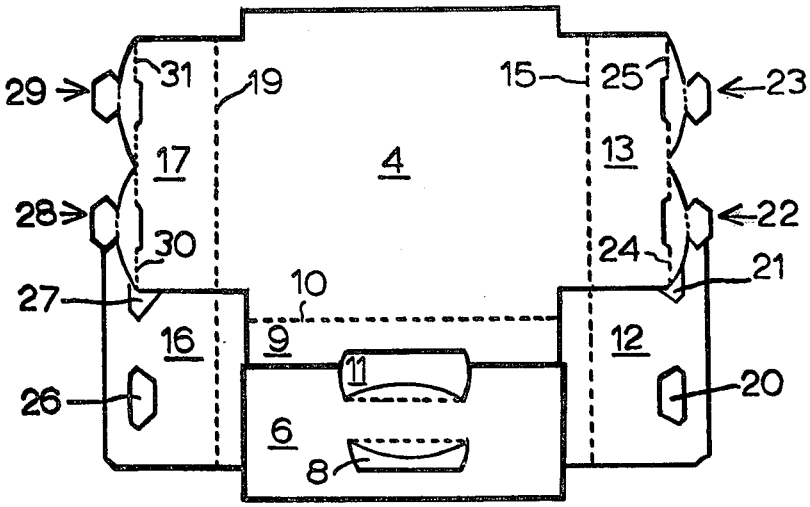
FIG. 3 depicts an intermediate stage through which the blank of FIG. 2 is manipulated in order to form a flat collapsed open-ended structure which may be set up and loaded through one or more of its open ends and whose ends are then closed and interlocked in order to form the carrier of FIG. 1.

In order to manipulate the blank form the condition represented in FIG. 2 to that shown in FIG. 3, an application of glue is first made to panel 6 as indicated by stippling in FIG. 2. Thereafter panels 4, 13, 17, and 9 and associated locking panels are elevated simultaneously and folded along fold line 5 so that panel 4 lies in flat face contacting relationship atop bottom panel 1 and a part of side wall 2. Thereafter top lap panel 6 is folded along fold line 7 into flat face contacting overlapping relationship with top lap wall panel 9. This operation of course secures panels 6 and 9 in overlapping relationship and in this manner a composite top wall is formed in which hand gripping apertures 8 and 11 are disposed. The carrier as shown in collapsed form in FIG. 3 is in the condition in which it is formed by the carton manufacturer.

The carton user or packager sets up the carton as shown in FIG. 3 into tubular form but with the end panels 12, 13, 16 and 17 open to accommodate end loading operations. After the carrier is loaded with a plurality of articles, the panels 12 and 13 are swung into their closed overlapping positions with the inner edge of panel 12 disposed inside and in underlying relationship with respect to the inner edge of end panel 13. Panels 12 and 13 are then interlocked as shown in FIG. 1 in accordance with this ivention.

Locking panel 22 is shown in FIG. 4 and 5 in detail together with its associated locking aperture means 20 which is formed in panel 12. The interlocking structure as shown in FIG. 4 and by which panel 22 is shown in connection with aperture 20 is identical to the locking panels 23, 18 and 29 and their associated locking apertures 21, 26 and 27. The structure which comprises locking panel 22 and its associated locking aperture 20 is here desribed as being representative of the invention.

Locking panel 22 is foldably joined to door-like panel 13 along interrupted fold lines 24 between which locking heel 32 is disposed. Locking heel 32 is integral with panel 22 and is movable therewith. On the edge of locking panel 22 which is opposite from the fold lines 24, locking toe 33 is disposed and is foldably joined to locking panel 22 along fold line 34. Shoulders 35 and 36 extend laterally from the neck 34 which includes a hinge line between locking toe 33 and locking panel 22. As is best shown in FIG. 4 locking toe 33 along its side edges diverges outwardly from hinge line 34 as indicated at 37 and 38 and then converges along its side edges as indicated at 39 and 40. Locking aperture means 20 as shown is in the form of a single aperture having spaced parallel locking edges 41 and 42. Side edges 43 and 44 diverge in a direction away from locking edge 41 and converge toward locking edge 42 as indicated at 45 and 46.

In order to interlock the locking panel 22 and its associated panel 13 in overlapping relationship with respect to panel 12, panels 12 and 13 are first brought into substantial parallelism and into proximity with each other as shown in FIG. 5 and locking panel 22 is swung about its fold line 24 out of the plane 13 into a position of substantially normal relationship with respect to panel 13. Locking toe 33 is swung about its hinge line 34 in the opposite direction and into a position of flat face contacting relationship with respect to locking panel 22 to occupy the position depicted in FIG. 5. With the locking panel 22 and its associated locking heel 32 and locking toe 33 disposed as shown in FIG. 5, panel 13 is then moved toward panel 12 to cause locking heel 32 to enter the locking aperture 20 and with the locking heel 32 disposed alongside locking edge 42. With locking toe 33 disposed against panel 22 as shown in FIG. 5, locking panel 22 is rotated toward panel 12 and into flat face contacting relationship therewith. Since locking edges 41 and 42 of locking aperture 20 are spaced apart by approximately the same distance indicated X in FIG. 4 as the hinge lines 24 and 34 as indicated at X' in FIG. 4, swinging movement of locking panel 22 into flat face contacting relationship with panel 12 causes locking toe 33 to pass through the locking aperture 20. When this occurs, locking tow 33 is released and due to the inherent bias along hinge line 34, locking toe 33 swings away from locking panel 22 into a position of angular relationship therewith. Such swinging movement due to the inherent bias or "fight" of material along hinge line 34 causes the shoulders 35 and 36 of locking toe 33 to ride underneath the portions of panel 12 which define the divergent edges 43 and 44 of locking aperture 20. Thus when locking toe 33 comes into a position adjacent locking edge 41, the shoulders of locking toe 33 are securely disposed in interlocking engagement underneath those portions of panel 12 which define the locking edges 43 and 44 and which are adjacent the ends of locking edge 41. By this means locking toe 33 is positively and securely held in position adjacent to or against locking edge 41 due to the inherent bias or "fight" of the material along hinge line 34. In FIG. 1a the locking toe 33 is disposed at an acute angle to the plane of panel 12 and is disposed at an obtuse angle to locking panel 22 and to panel 13. A tension force across fold line 34 resists any tendency of toe 33 to slip through locking aperture 20.

By this invention, a secure interlock is provided which is not subject to inadvertent unlocking and which also is well adapted for the performance of an interlocking operation by static plows or the like and which are relatively simple and rugged in construction and which are virtually maintenance free.

The embodiments of the invention in which an exclusive property or privilege is claimed are defined as follows:

1. Interlocking means for securing two panels together in overlapping relation, said interlocking means comprising a locking panel foldably joined to one of the panels, a locking heel integral with said locking panel and projecting therefrom, a locking toe foldably joined to said locking panel and having a neck portion and outwardly projecting shoulders, and locking aperture means formed in the other panel and having spaced locking edges one of which is at least as long as the width of said neck portion of said locking toe and said locking aperture means having holding edges spaced apart and configured so that said shoulders of said locking toe can swing directly through said locking aperture from a position of substantially flat face contacting relation with said locking panel without deformation of said locking toe in such manner that the shoulders of said locking toe are interlocked with parts of the other panel adjacent said holding edges and adjacent said one locking edge and so that said locking heel is adjacent the other of said locking edges due to the angular disposition of said locking toe relative to said other panel which is maintained by the inherent bias exerted on said locking toe at said neck portion tending to urge said locking toe into engagement with said one of said locking edges so that a tension force at said neck portion resists any tendency of said locking toe to slip out of said locking aperture whereby said locking heel is retained within said aperture means and in engagement with the other of said locking edges thereby to prevent substantial relative movement between the panels.

2. Interlocking means according to claim 1 wherein said holding edges are substantially straight and diverge in a direction away from said one locking edge.

3. Interlocking means according to claim 1 wherein said spaced locking edges form generally opposite edges of a single common locking aperture.

4. Interlocking means according to claim 1 wherein said spaced locking edges are generally parallel to each other.

5. Interlocking means according to claim 4 wherein said locking edges are spaced apart by a distance approximately equal to the space between the fold line between said locking panel and said one panel and the fold line between said locking toe and said locking panel.

6. Interlocking means according to claim 1 wherein the fold line between said locking panel and said one panel is approximately parallel with the fold line between said locking toe and said locking panel.

7. Interlocking means according to claim 1 wherein said locking heel projects from said locking panel and beyond the fold line between said locking panel and said one panel.

8. Interlocking means according to claim 7 wherein the side edges of said locking heel converge in a direction away from said locking panel.

9. Interlocking means according to claim 1 wherein the side edges of said locking toe diverge from said neck portion thereof for a part at least of the side edges thereof.

10. Interlocking means according to claim 9 wherein said holding edges diverge from said one locking edge by an angle substantially the same as the angle of divergence of said part of the side edges of said locking toe.

11. Interlocking means for securing two panels together in overlapping relation, said interlocking means comprising a locking panel foldably joined to one of the panels, a locking heel integral with said locking panel and projecting therefrom, a locking toe foldably joined to said locking panel and having a neck portion and outwardly projecting shoulders, and locking aperture means having spaced locking edges and spaced holding edges formed in the other panel and configured so that it is capable of receiving said locking heel and said locking toe without substantial deformation following folding of said locking toe out of substantially flat face contacting relation with said locking panel in such manner that the shoulders of said locking toe are interlocked with parts of the other panel and directly through said locking aperture adjacent said holding edges by the inherent bias exterted on said locking toe tending to urge said locking toe into engagement with one of said locking edges to establish a tension force across the fold line between said locking toe and said locking panel which positively holds said locking toe within said locking aperture means against any tendency of said locking toe to slip out of said aperture means whereby said locking heel is retained within said aperture means and in engagement with the other of said locking edges thereby to prevent substantial relative movement between the panels.

* * * * *